US006332930B1

(12) United States Patent
Rose

(10) Patent No.: US 6,332,930 B1
(45) Date of Patent: Dec. 25, 2001

(54) PIPELINE CLEANING

(75) Inventor: Michael Rose, Loughborough (GB)

(73) Assignee: Lattice Intellectual Property Ltd. (GB)

( * ) Notice: Subject to any disclaimer, the term of this patent is extended or adjusted under 35 U.S.C. 154(b) by 0 days.

(21) Appl. No.: 09/554,578

(22) PCT Filed: Nov. 6, 1998

(86) PCT No.: PCT/GB98/03331

§ 371 Date: Oct. 25, 2000

§ 102(e) Date: Oct. 25, 2000

(87) PCT Pub. No.: WO99/25495

PCT Pub. Date: May 27, 1999

(30) Foreign Application Priority Data

Nov. 18, 1997 (GB) ..... 9724231

(51) Int. Cl.[7] ..... B08B 9/043

(52) U.S. Cl. ..... 134/8; 15/104.05; 15/104.16; 15/104.51

(58) Field of Search ..... 15/104.05, 104.067, 15/104.068, 104.069, 104.16, 104.31, 104.33; 134/6, 8, 22.1, 22.11

(56) References Cited

U.S. PATENT DOCUMENTS 1,185,688 * 6/1916 Marsh .
1,733,512 * 10/1929 Parker .
4,337,096 6/1982 Clifford .
4,562,608 * 1/1986 Weir .
5,444,887 * 8/1995 Rufolo .
6,099,657 * 8/2000 Boyer .

FOREIGN PATENT DOCUMENTS 704646 2/1954 (GB) .

* cited by examiner

*Primary Examiner*—Terrence R. Till
(74) *Attorney, Agent, or Firm*—Larson & Taylor, PLC

(57) ABSTRACT

A pipeline cleaning arrangement that includes a cleaning pig with guide units at each end. A tow cable, via a cone, pulls the pig assembly in a forward direction. The tow cable then pulls the cone in a rearward direction. The pig is configured with two cleaning portions that separate in the forward direction to avoid debris collection and abut in the rearwards direction to collect pipeline debris and carry this to the entry point for removal via a suction tube.

17 Claims, 5 Drawing Sheets

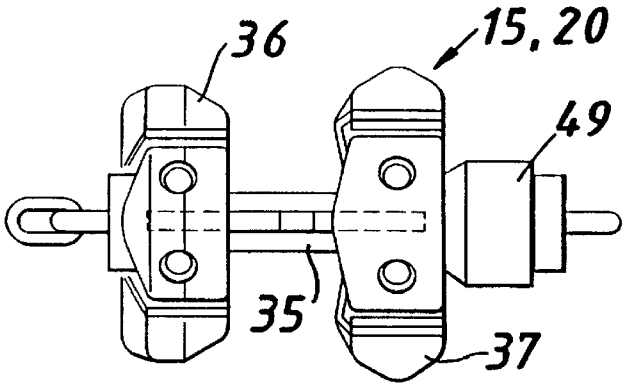
FIG. 2.
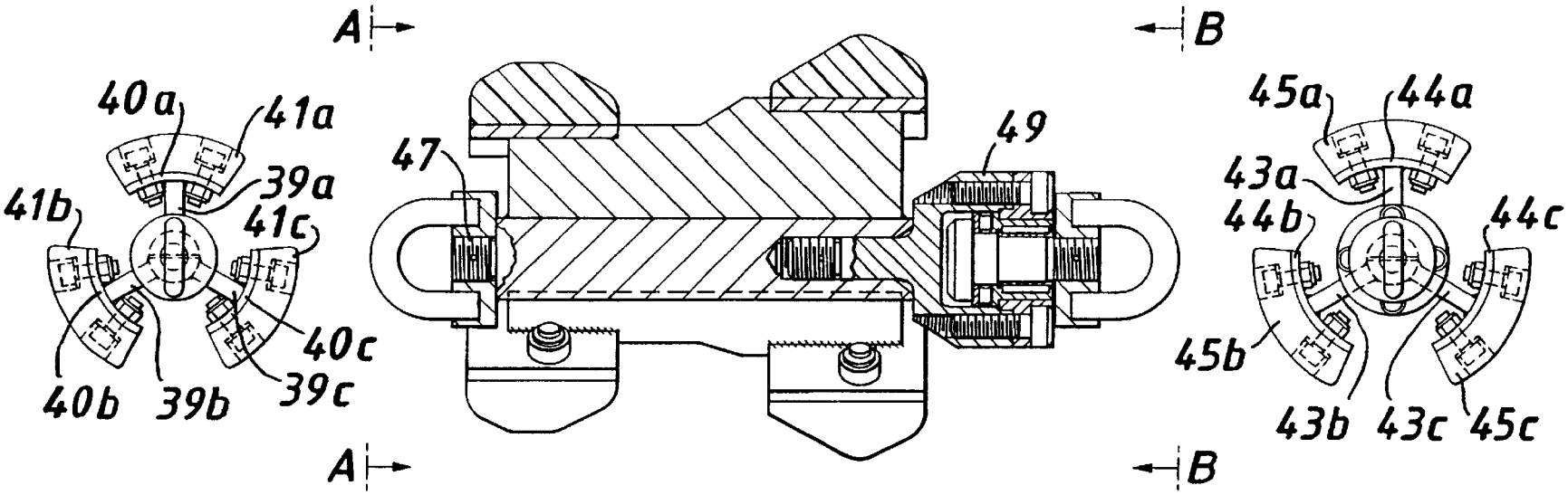

PIPELINE CLEANING

The present invention relates to pipeline cleaning and more particularly to pipeline typically carrying fluid at the time of cleaning, so called 'live' operation.

In gas mains, for example, debris typically in the form of light dust through to heavy bonded scale can build up in the pipeline and it is necessary to remove this. If excessive this needs to be removed prior to any internal inspection and repair. The effective diameter of the pipe will also become reduced due to such build up. In addition filter blockage in gas governor stations can occur as can valve diaphragm damage. In the past it has been necessary to shut down the section of the pipeline to allow access to the pipeline in a decommissioned state. To do so means interrupting the supply of gas to consumers and associated problems.

In U.S. Pat. No. 4,827,553 a cleaning device is disclosed with a hinged portion for effecting cleaning.

The present invention is concerned with arrangements which allow the cleaning of the pipeline whilst still allowing the option of supplying gas or other fluid through the pipeline, even when the gas may be fuel gas or the like.

According to the invention there is provided a cleaning pipe for cleaning debris from a fluid pipeline comprising:

slider means, and first and second cleaning portions, at least one of said portions cooperating with the slider means to permit movement of the portions towards each other or apart, so as to allow passage of the pigs from a first location to a second location along the pipeline without collecting any substantial amount of debris when the portions are apart, and to cause cleaning of the pipeline by transporting debris during passage of the pig from the second to the first location when the portions are together, the pig including means to cause the portions to move towards each other or apart in dependence on the direction of travel of the pig through the pipeline.

Further according to the invention there is provided a method of cleaning a pipeline the method comprising:

providing first and second cleaning portions of a pig in slidable relationship, moving the pig from a first location to a second location along the pipeline without collecting any substantial amount of debris whilst the cleaning portions are spaced apart, and moving the pig from the second location to the first location along the pipeline so as to cause the cleaning portions to move towards each other so as to allow the pig to transport debris from the second location to the first location, the portions being configured so that they move towards each other or apart in dependence on the direction of travel of the pig through the pipeline.

The invention will now be described by way of example with reference to the accompanying drawings in which:

FIG. 2 shows an embodiment of the guide unit structure employed in FIG. 1;

Figure 1:
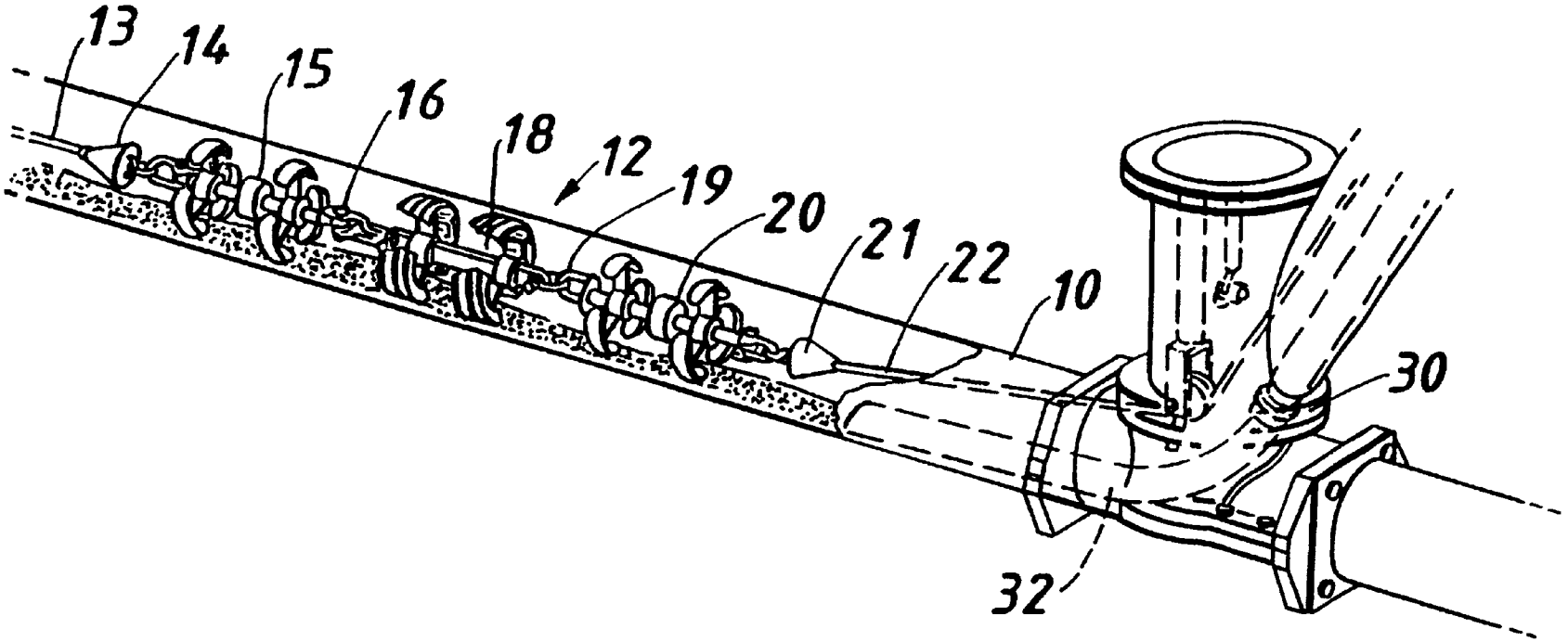
FIG. 1 shows the cleaning pig and associated components located in a pipeline.

The arrangement of FIG. 1 shows a portion of pipeline 10 with a collector or cleaning pig arrangement 12. The arrangement includes a towing cable 13 with tow cone 14 connected to a first guide unit 15.

The guide unit is connected by coupling 16 to a dredging or cleaning pig 18. The rear of the pig 18 is itself connected to a second guide unit 20 via coupling 19.

The second guide unit 20 is connected to a cone 21 and towing cable 22.

In practice the arrangement is towed in a forward direction by cable 13 to a desired position and thereafter towed in a rearward direction by cable 22 to effect cleaning or dredging of the pipeline as described in more detail below.

Access to the pipeline is via entry point 30 which includes a seal to prevent gas escape around the cable and an entry point at the other end of the pipe section will be provided (not shown) to accommodate the cable 13 in sealed manner.

As an initial step in the cleaning process, prior to insertion of the pig 18, the cable 13 will have been connected following the passage of a parachute type device which is carried down the pipeline by the flow of gas to the front exit point.

A camera may follow this passage prior to insertion of the pig 18 to ensure debris build up is not too great to operate the system. The camera will also help establish the length of pipeline that can be traversed before the cleaning operation commences.

Debris dredged by the pig can be removed from the entry point 30 by means of a vacuum system terminating in suction tube 32. An arrangement including the winch for the cable and camera and control unit together with more details of the sealing arrangements and vacuum device is the subject of our copending UK patent application 9705182.5.

The construction of the guide units 15 and 20 of FIG. 1 is now shown in more detail in FIG. 2.

Each guide unit comprises a central bar portion 35 supporting first and second guide portions 36 and 37.

The first guide portion includes three legs 39*a–c* spaced at 180 degrees and ending in curved shoe portions 40*a–c*.

The shoe portions each terminate in a curved plastic (i.e. Delrin) face 41*a–c,* respectively.

The second guide portion 37 includes three legs 43*a–c* spaced at 180 degrees and ending in curved shoe portions 44*a–c*.

The shoe portions each terminate in a curved plastic face 45*a–c,* respectively.

At one end of the bar 35 a simple tow eye 47 is provided to allow connection to be made to the towing mechanism.

At the other end of the bar 35 is a bearing and tow eye assembly 49 to allow rotation of the tow eye.

It is to be noted that the first guide portion 36 has an overall diameter that is smaller than that of the second guide portion diameter. This is to facilitate passage through the pipeline as it is pulled by the towing cable.

In practice the guide units are arranged in the pipeline to each have the larger diameter portion nearer to the pig 18 to maximize the guiding action whether the pig is being pulled in a forward or rearward direction. The bearing and tow eye assembly 49 on each guide unit will connect to the pig 18 (as shown in FIG. 1). The gas within the pipeline can pass through the gaps in the guide units without restriction.

Figure 3:
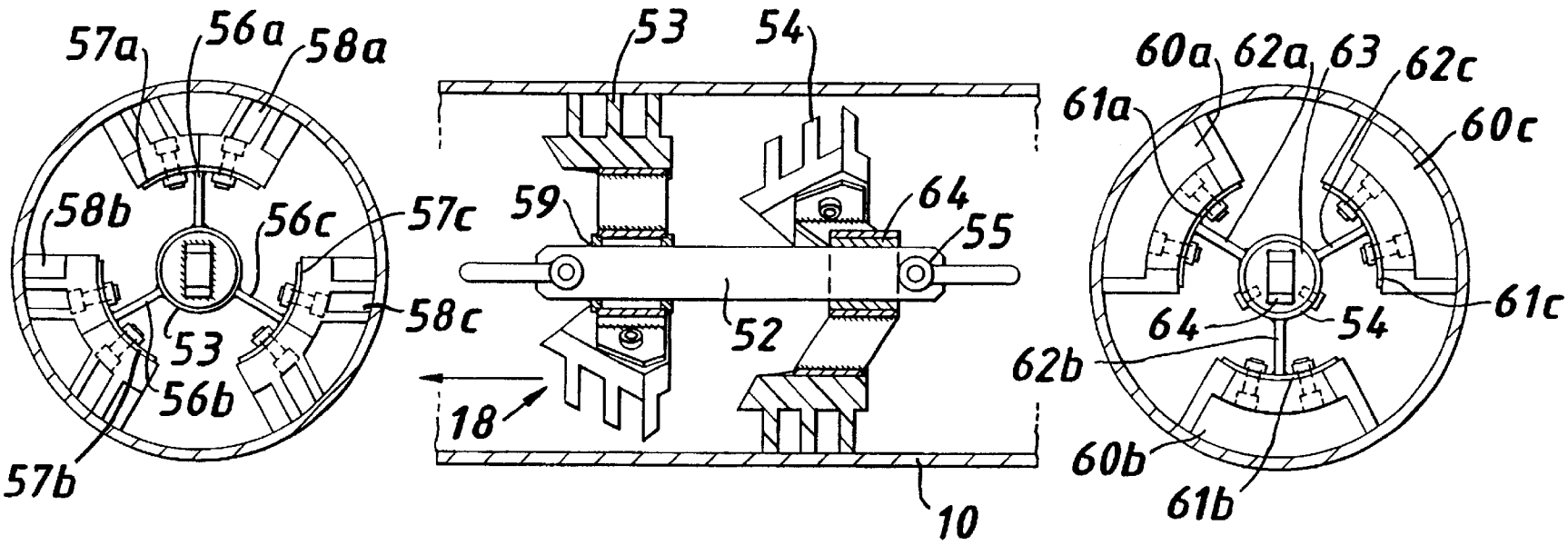
FIG. 3 shows the cleaning pig of FIG. 1 in more detail.
Figure 4:
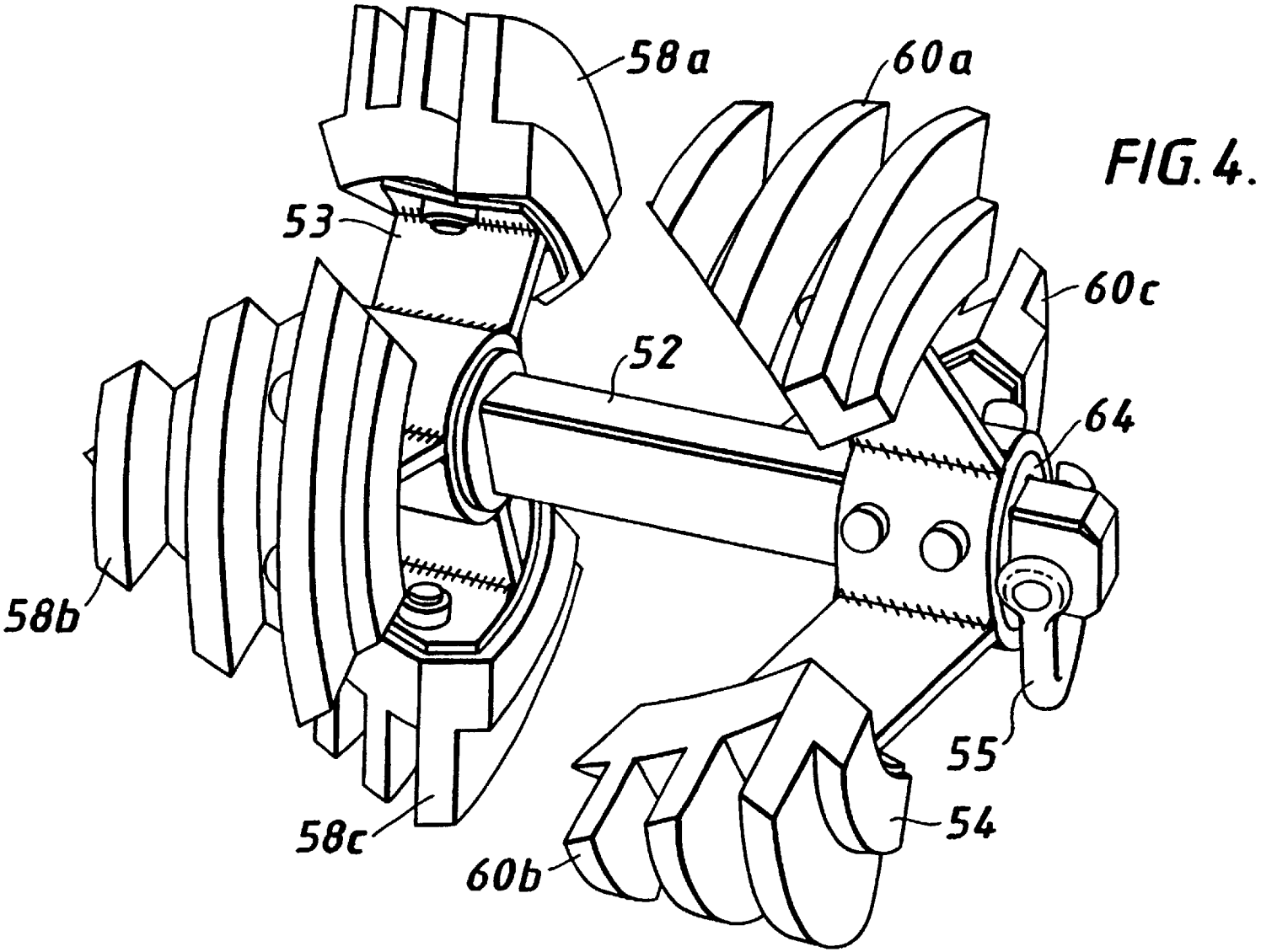
FIG. 4 shows the cleaning pig with the two segments shown in the separated position equivalent to it being towed in the forward direction.
Figure 5:
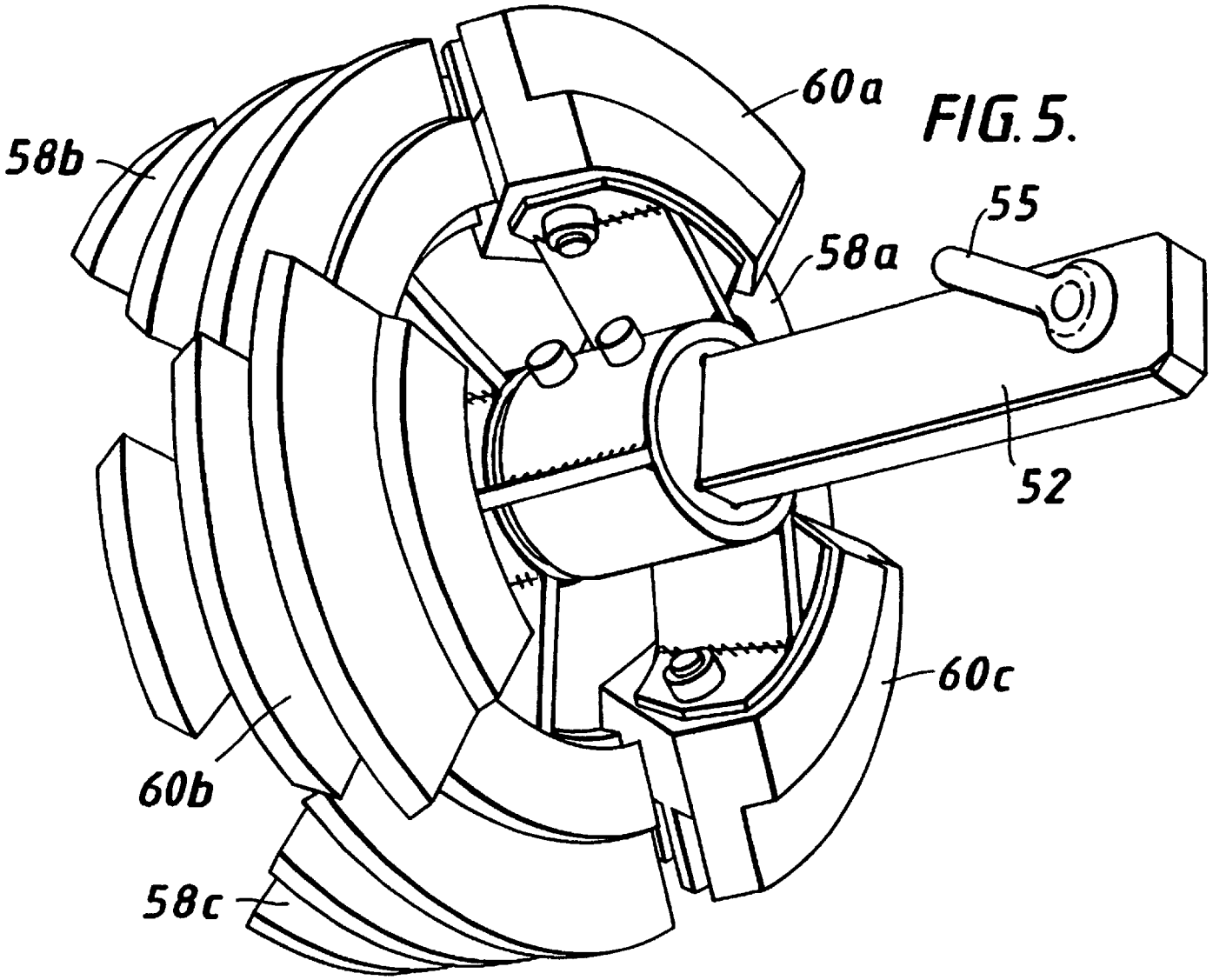
FIG. 5 shows the cleaning pig with the two segments in the abutting position equivalent to it being towed in the rearward direction.

The pig 18 of FIG. 1 is shown in more detail in FIGS. 3 to 5.

The pig 18 is constructed with a bar 52 carrying a first fixed segment 53 (see FIG. 3). A second segment 54 is slidably mounted on the bar 52 and its travel is limited by contact with either the first segment 53 or shackle 55 affixed to the bar (see also FIG. 4).

The first segment 53 includes three leg portions 56*a–c* spaced apart by 120 degrees and affixed to the bar 52 (e.g.

welded at point 59). The leg portions terminate in shoe portions 57*a–c*. The shoes carry respectively plastic (i.e. polyurethane) blades 58*a–c*. The blades are of triple construction but have gaps to accommodate the second sliding segment 54 in the return travel (see also FIG. 5).

The blades are positioned 45 degrees offset from each other to cover the entire pipe wall when mated with the second segment.

The second segment 54 has blades 60*a–c* are mounted on shoes 61*a–c* at the ends of leg portions 62*a–c* spaced at 120 degrees and of triple construction. The leg portions 62*a–c* terminate at ring 63 which is fixed to slotted slider 64 to allow the sliding action to be easily effected.

In use, the pig within the pipeline 10 (see FIG. 1) will be pulled via guide unit 15 by the tow cable 13 in a forward direction. As it does so the two segments will move apart as a result of friction between the blades 60*a–c* and the pipe wall causing the segment 54 to slide to its rearward position.

This separation allows the pig to move over debris without collection, due to the gaps between the blades in both segments. Some of this debris may have been loosened by the blades on the pigs as it travels.

Once a suitable point in the pipeline has been reached the operation is reversed and the towing cable 22 takes over.

Friction between the blades 60*a–c* and the pipe walls will cause the second segment to slide until it mates with the first segment (as shown in FIG. 5) thus providing an uninterrupted blade surface to the pipe wall and in this mode it scrapes the internal wall releasing deposits and loose debris such as dust using a dredging action. The combination of blade portions thus form a disk-like profile. Due to the gaps between the legs of the pig, gas can still flow without interruption allowing 'live' operation, due to this central bypass.

The construction assists in scraping and collecting debris without undue dust swirling which would then be deposited elsewhere. At the point 30 the debris can be removed by vacuum techniques via tube 32. The debris together with any gas extracted will be filtered and the gas remnant can then be returned to the pipeline.

The polyurethane blades are rigid (typically 25 mm thick), but on a pipeline of 8 inches typically carrying gas at 2 bar, the stresses on towing will cause the blades to distort which assist in the contact with the pipe wall and hence the scraping action.

The plastic structure of the blades, bend under force so protecting any service connections, which may otherwise be damaged by steel or similar blades. The boat shaped blades dig or plough through the material.

The central aperture portion in the scraping and dredging mode still allows a bypass of about about 3 inches for the gas in the pipeline so ensuring continuity of supply.

The cleaning can be effected at a relatively rapid rate of 2 meters/second. Other pipe diameters can be accommodated by selecting appropriate dimensions for the pig assembly.

The presence of the guide units assist in maintaining the correct central position of the cleaning pig in either direction of travel through the pipeline as well as providing guidance at bends in the pipeline (typically 1D blends).

The arrangement allowing travel forward without collection and thereafter to travel rearwards collecting the debris, allows a combined single entry and exit point to be utilised.

I claim:

1. A cleaning pig for cleaning debris from a fluid pipeline comprising:

slider means, and first and second cleaning portions, at least one of said portions cooperating with the slider means to permit movement of the portions towards each other or apart, so as to allow passage of the pig from a first location to a second location along the pipeline without collecting any substantial amount of debris when the portions are apart, and to cause cleaning of the pipeline by transporting debris during passage of the pig from the second to the first location when the portions are together, the pig including means to cause the portions to move towards each other or apart in dependence on the direction of travel of the pig through the pipeline.

2. A pig as claimed in claim 1 including means for providing an aperture for fluid flow irrespective to the direction of passage of the pig in the pipeline.

3. A pig as claimed in claim 2 wherein the means causing the portions to move apart to effect separation include means for contacting the pipeline wall to allow the second portion to move away from the first portion via the slider means due to frictional forces exerted by the means contacting the wall during travel of the pig from the first to the second location.

4. A pig as claimed in claim 3 wherein the means causing the portions to move towards each other to effect abutment include means for contacting the pipeline wall or debris to allow the second portion to move towards the first portion via the slider means due to friction during travel of the pig from the second to the first location so as to collect and transport debris therein.

5. A pig as claimed in claim 3 wherein the means for contacting the pipeline wall includes at least one scraper configured to remove debris from the pipeline wall in at least one direction of travel.

6. A pig as claimed in claim 5 wherein the at least one scraper comprises a plurality of plastic blade segments.

7. A pig as claimed in claim 5 wherein the scraper arrangement on the first portion is configured to locate within apertures between a scraper arrangement on the second portion.

8. A pig as claimed in claim 5 wherein a plurality of scrapers are provided each in the form of resilient elements in combination of generally disk shape.

9. A pig as claimed in claim 1 including guide means configured to be located both in front and to the rear of the pig during travel through the pipeline, the guide means assisting in maintaining the correct position of the pig within the pipeline.

10. A pig as claimed in claim 9 wherein the guide means each include a body portion carrying a plurality of legs terminating in shoe portions configured to contact the pipeline wall during travel.

11. A pig as claimed in claim 10 wherein each guide means includes two separate sections each carrying a plurality of legs terminating in shoe portions, the shoe portion configured to be adjacent the pig during travel extending closer to the pipeline wall in use than the other shoe portion.

12. A pig as claimed in claim 1 including a towing cable for moving the pig in a forward direction and a towing cable for moving the pig in a reverse direction.

13. A method of cleaning a pipeline the method comprising the steps of:

providing first and second cleaning portions of a pig in slidable relationship, moving the pig from a first location to a second location along the pipeline without collecting any substantial amount of debris whilst the cleaning portions are spaced apart, and moving the pig from the second location to the first location along the pipeline so as to cause the cleaning portions to move towards each other so as to allow the pig to transport debris from the second location to the first location, the portions being configured so that they move towards each other or apart in dependence on the direction of travel of the pig through the pipeline.

14. A method as claimed in claim 13 including the step of providing an aperture in the pig to allow fluid flow through the pipeline.

15. A method as claimed in claim 13 including the step of abutting the first and second cleaning portions so as to form a plurality of disk shaped segments having a scraping action.

16. A method as claimed in claim 13, including the step of providing guide means both in front and to the rear of the pig to assist in maintaining the pig in the correct position within the pipeline.

17. A method as claimed in claim 13 including the step of towing the pig in a forward or reverse direction to effect movement.

* * * * *